US011027887B1

(12) United States Patent
Rearick

(10) Patent No.: US 11,027,887 B1
(45) Date of Patent: Jun. 8, 2021

(54) MULTI PURPOSE-FUNCTIONAL PAINT BUCKET

(71) Applicant: Cathleen Rearick, Metairie, LA (US)

(72) Inventor: Cathleen Rearick, Metairie, LA (US)

(73) Assignee: Cathleen Jo Rearick, Metairie, LA (US)

( * ) Notice: Subject to any disclaimer, the term of this patent is extended or adjusted under 35 U.S.C. 154(b) by 0 days.

(21) Appl. No.: 16/713,290

(22) Filed: Dec. 13, 2019

(51) Int. Cl.

| | |
|---|---|
| ***B67D 3/00*** | (2006.01) |
| ***B65D 25/46*** | (2006.01) |
| ***B44D 3/12*** | (2006.01) |
| ***B65D 83/44*** | (2006.01) |
| ***B65D 83/06*** | (2006.01) |
| ***B65D 25/54*** | (2006.01) |

(52) U.S. Cl.
CPC ..... *B65D 25/46* (2013.01); *B44D 3/12* (2013.01); *B65D 25/465* (2013.01); *B65D 25/54* (2013.01); *B65D 83/06* (2013.01); *B65D 83/44* (2013.01); *B67D 3/0029* (2013.01); *B65D 2203/04* (2013.01)

(58) Field of Classification Search
CPC ..... B65D 25/46–465; B65D 83/06; B67D 3/0029; B67D 1/0891; B67D 1/0894; B67D 1/16; A47J 31/4482; B44D 3/12
USPC ..... 222/108–111, 181.1–181.3, 184, 185.1, 222/527–530
See application file for complete search history.

(56) References Cited

U.S. PATENT DOCUMENTS

| | | | | |
|---|---|---|---|---|
| 3,476,295 | A * | 11/1969 | Telfer | F25D 23/126 222/183 |
| 6,988,639 | B2 * | 1/2006 | Arch | B65D 77/061 222/105 |
| 7,159,718 | B2 * | 1/2007 | Cassina | B65D 65/42 206/386 |
| 7,575,118 | B2 * | 8/2009 | Richter | B65D 77/0466 206/386 |
| 7,793,690 | B2 * | 9/2010 | Voglewede | F25D 23/126 141/362 |
| 7,878,327 | B2 * | 2/2011 | Cassina | B65D 19/10 206/386 |
| 8,025,083 | B2 * | 9/2011 | Dumkow | B67D 1/0894 141/378 |
| 9,648,981 | B2 * | 5/2017 | Baldo | A47J 31/46 |
| 2009/0308493 | A1 * | 12/2009 | Buchstab | A47J 31/4482 141/378 |
| 2015/0008242 | A1 * | 1/2015 | Kpabar, Jr. | B67D 3/0061 222/183 |

* cited by examiner

*Primary Examiner* — Patrick R Durand
*Assistant Examiner* — Randall A Gruby

(57) ABSTRACT

A container used for holding and dispensing materials, the container has cutouts for holding or storing, clear strips for visual observance, and a spout and tray that are each extendable and retractable.

5 Claims, 6 Drawing Sheets

MULTI PURPOSE-FUNCTIONAL PAINT BUCKET

I Cathleen Rearick of Metairie, La have designed new and much needed improvements to (but not limited to) the 5 gallon paint bucket/container. These improvements are not limited to just paint but to other fields of industries such as paint, oil, grain or other fields where liquids, powders, grains or anything else that is stored in buckets or containers. There will 2-4 cut outs/recesses/bevels around the rim of the bucket/container. There will be 2-4 clear vertical strips from top to bottom on 2-4 sides of the bucket/container. There will be a "shadow box" type cut out towards the bottom of the bucket that will have a flexible spigot/pour spout that will face in the up position when not in use and when in use will pull down. The spout/spicket will have either a button or a lever for continuous pour of manual pour. When finished with spicket/spout simply bend the flexible tubing in an upward position until next use. Under the "shadow box" there will be a half moon curved tray that will hide away in the bucket/container until pour spout/spigot is in use then the tray can turn until finished using then turn back around to hide away.

The purpose of this invention is to solve some much needed improvements and help save time, materials and injury. First we have 2-4 cut outs/recesses/bevels around the rim of the bucket/container. These cut outs will recess deep enough just below the rim of the bucket/container so that a 9" roller frame (but not limited to a 9" roller frame, may be a smaller or larger frame) handle which holds a nap to which you roll paint on the walls with could have a new or used roller nap still on the frame and can be placed in one of the recess/cutouts with the frame holding the nap can be placed hanging toward the inside of the bucket/container flush exposing the handle of the roller frame to the outside of the bucket/container. This will allow the cap/top/lid of the bucket/container to be placed back on the bucket/container to fit tightly without any lumps, uneven placement of top or exposing any open areas due to inability to replace lid/top that may/can dry out (but not limited to) paint inside bucket/container The clear strips on various sides of the bucket/container will help you to see how much material (powder, liquid, grain etc) is still in the container without having to go over to the bucket/container and either open it up to look inside, having to pick it up and feel the weight of the bucket or to check the color of paint or other material that may be inside (corn, beans, flour etc). This will be visible from the vertical strips/lines that will be strategically placed around the outside of bucket/container.

The "shadow box" with the spigot/spicket/spout will help make pouring paint from a large container to a smaller container much easier than having to lift the bucket/container. The spigot/spout will have silicon tubing which repels paint, oils and other materials from sticking to or drying to it. When the spout is pulled in the downward position paint or any other material inside will be ready to flow from the inside of the bucket/container to the outside when the handle/button is pressed. When the spigot/spicket/spout is put in the upward position it is in the closed position and the residual fluid will drain back into the bucket/container and will hold until next use.

The half moon hideaway tray when pushed on one side or the other of the tray will allow you to grab the tray and rotate around to the outward position to catch any drips or spills that can occur with filling smaller containers/cups/bowls etc.

then can be returned back to a hideaway position that lays in a flush position within the bucket/container when finished using/filling.

After painting instead of rapping your roller nap in plastic, a bag or trying to hang the roller frame with nap still attached on the inside of the bucket without the cut outs/inserts will cause the lid of the bucket/container not to fit back on the bucket tightly but usually does not fit to close at all. This causes the roller nap to dry out and paint forms a hard shell over the top due to air exposure causing clumps to form in the paint and further need to spend time and money running paint through a cheese cloth or a filter of some sort to remove clumps (also known as boogers) and usually results in throwing away paint and buying fresh new paint.

The clear silicon (but not limited to silicon) strips help to see from a distance how much material is still in bucket/container without lifting container, walking back to location of material or reopening container.

The "shadow box" spicket/spout/spigot will help relieve the weight of picking up bucket/container to constantly pour to refill smaller containers, cups or buckets which can be hard on your back. The silicon flexible tubing repels/prohibits paint from forming, sticking or drying to inside of tubing.

Hideaway tray collects any drips that may fall and then turns back around to hideaway.

The purpose of this newly designed bucket/container is to help reduce the amount of waste; injury and money on materials spend which will cut cost for Companies, Commercial work and/or Residential work.

BRIEF DESCRIPTION OF DRAWINGS

Figure 1:
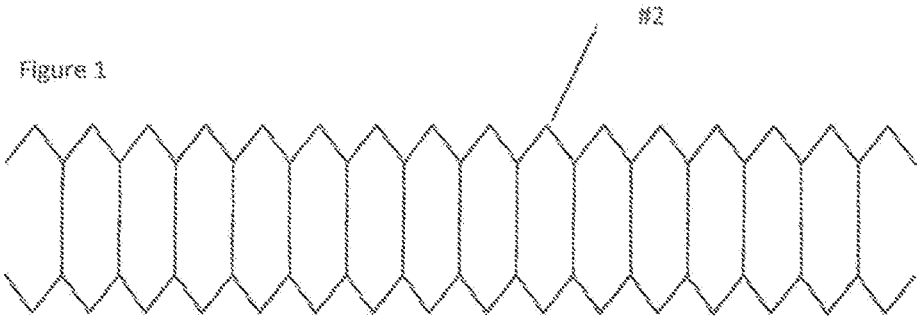
FIG. 1: Flexible Tubing
Figure 2:
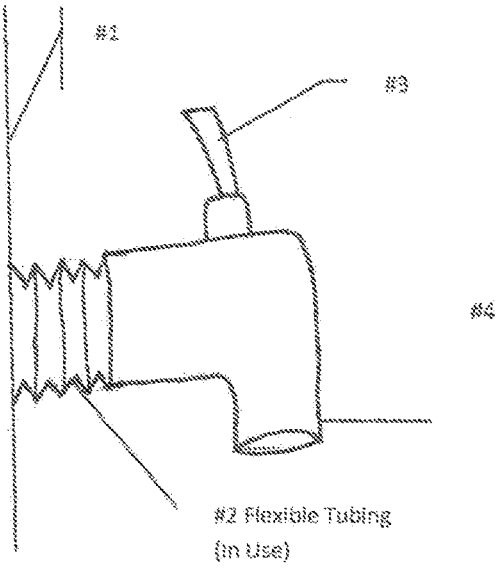
FIG. 2: Side view of device
Figure 3:
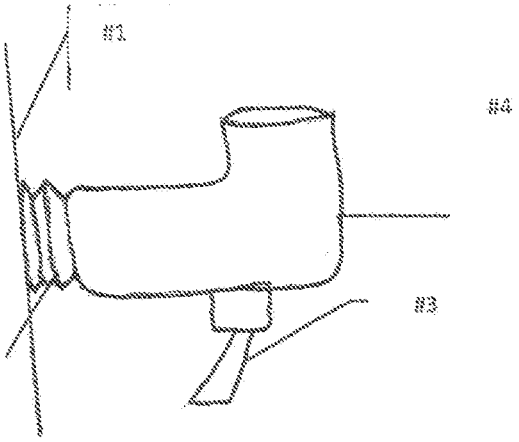
FIG. 3: Side of device
Figure 4:
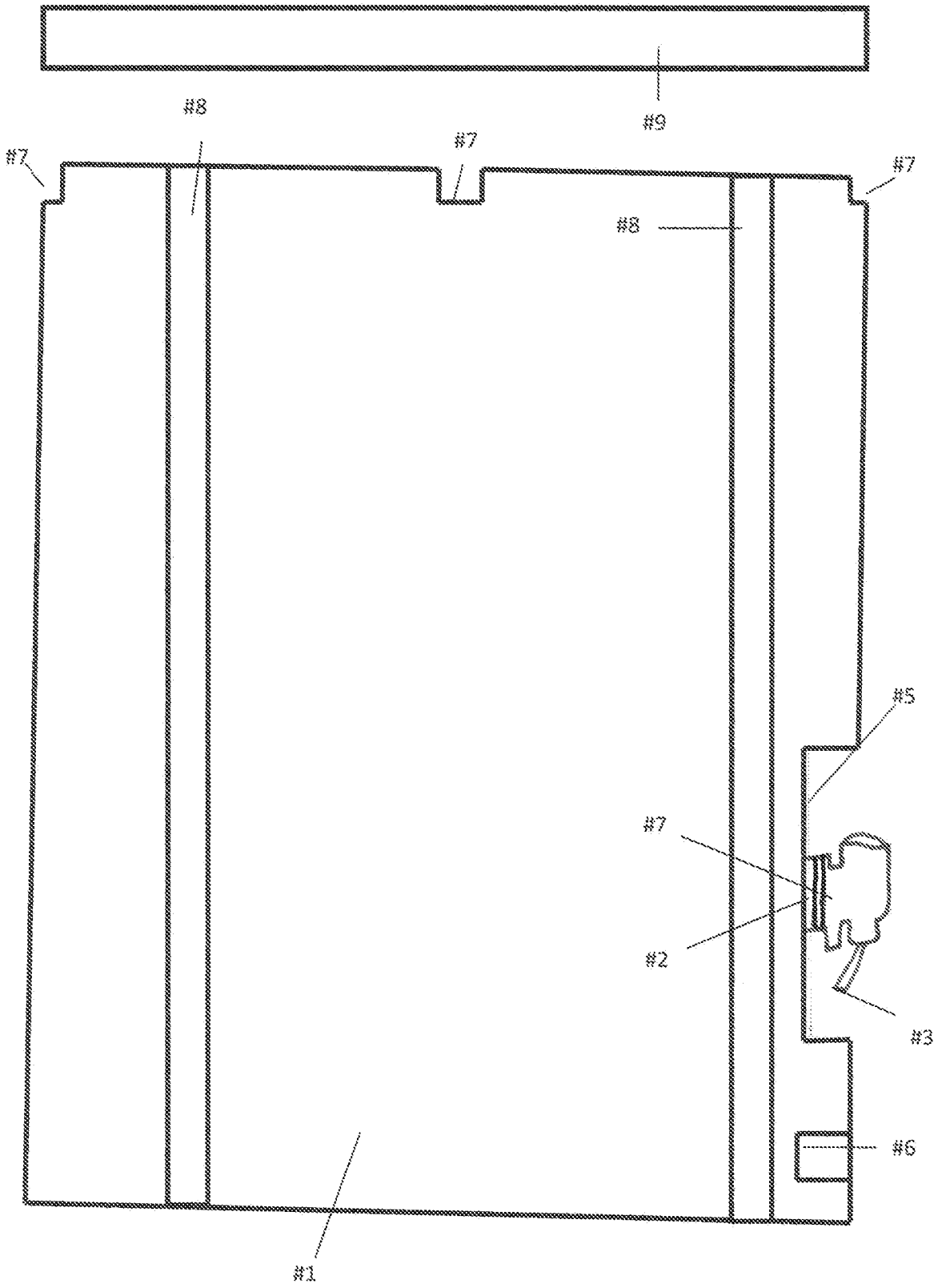
FIG. 4: Side View of Reservoir
Figure 5:
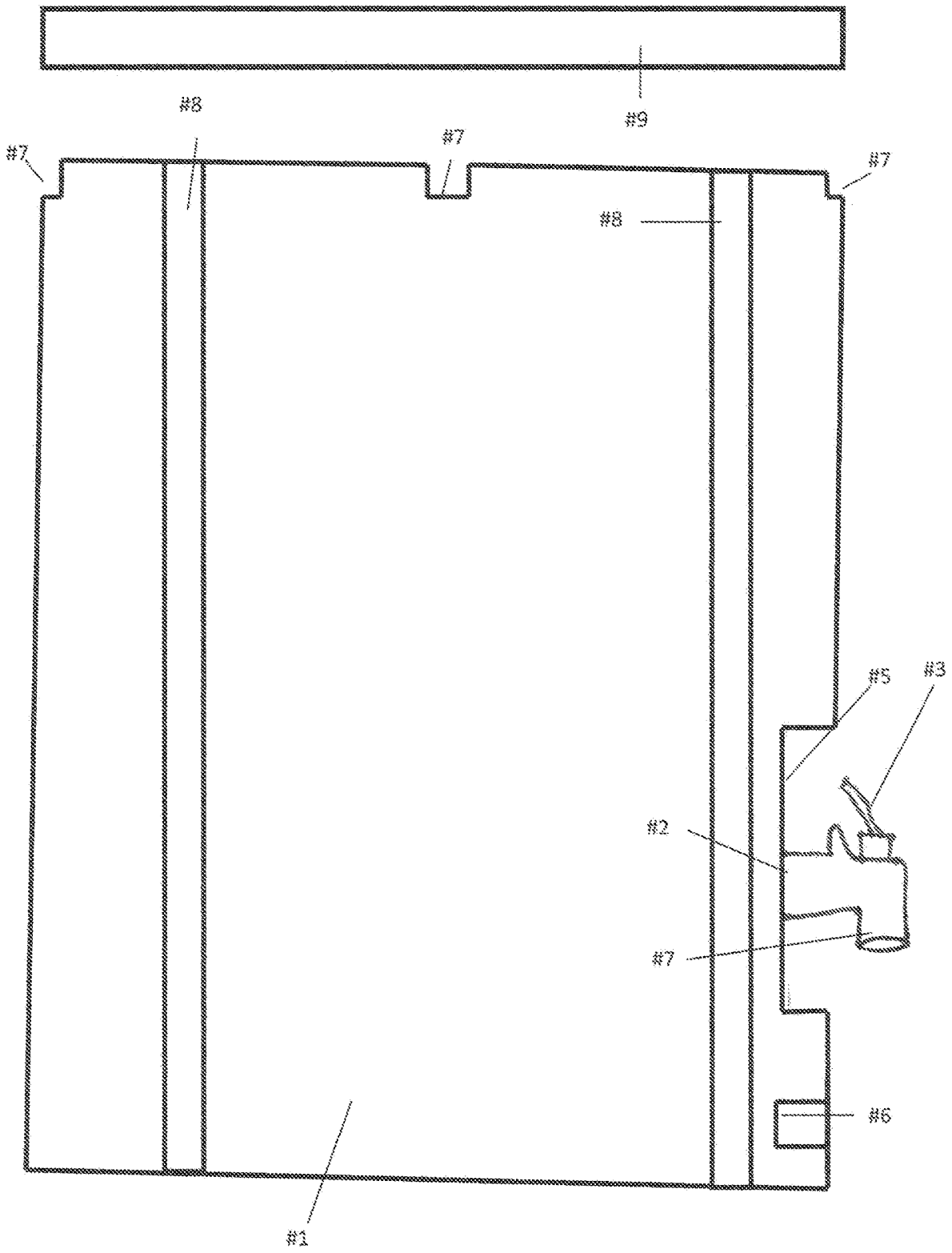
FIG. 5: Side View of Reservoir
Figure 5:
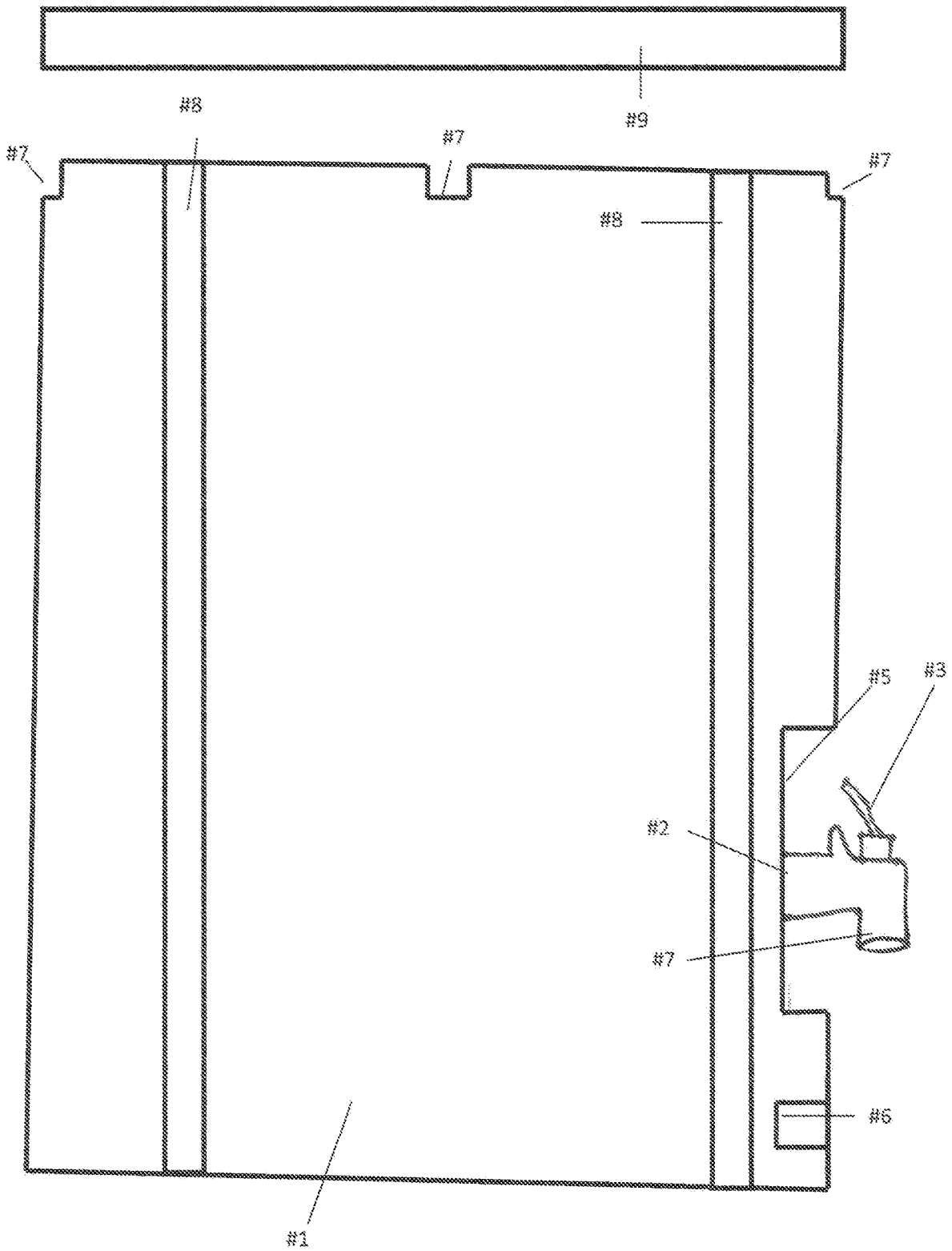
Figure 6:
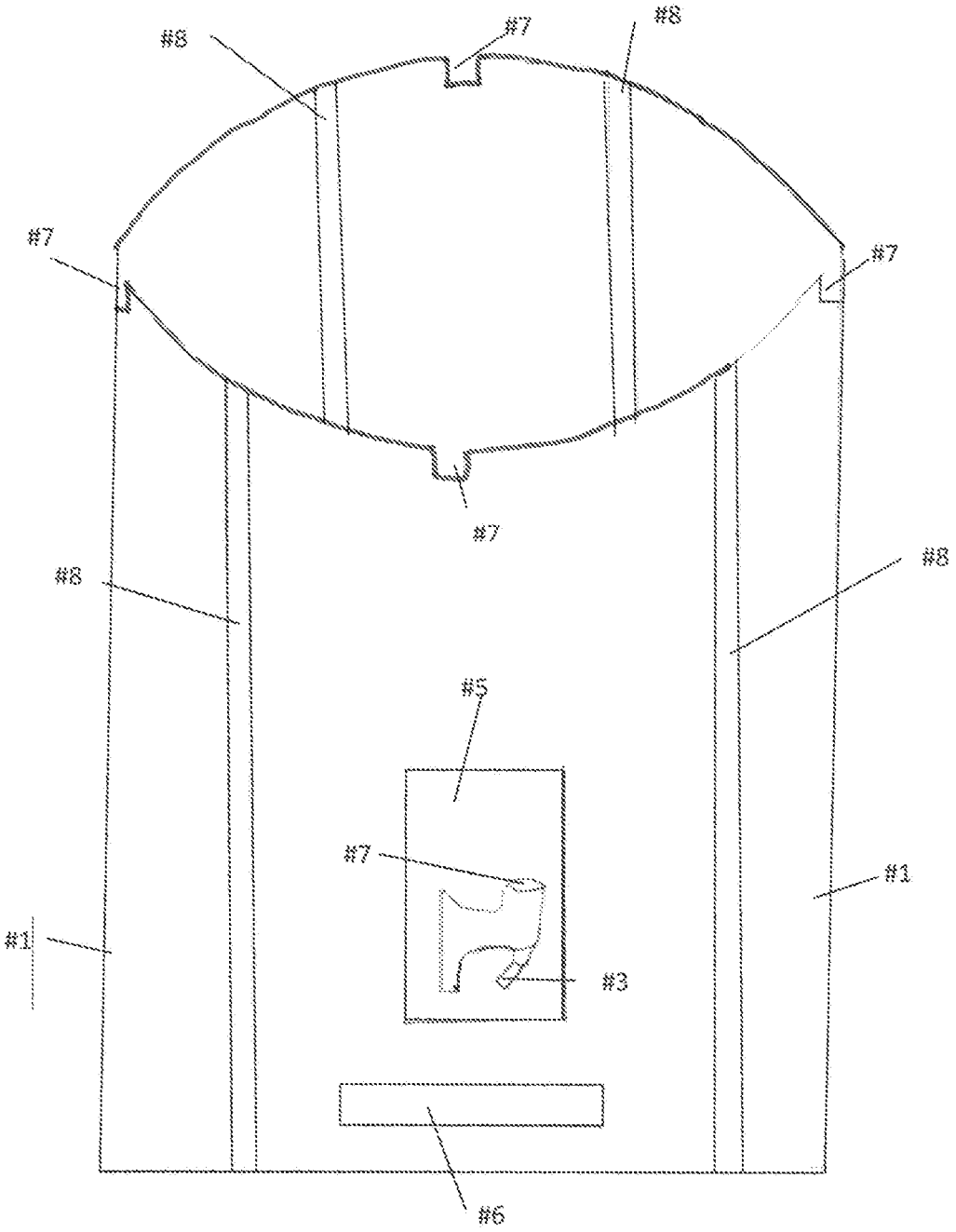
FIG. 6: Front View of Reservoir
Figure 7:
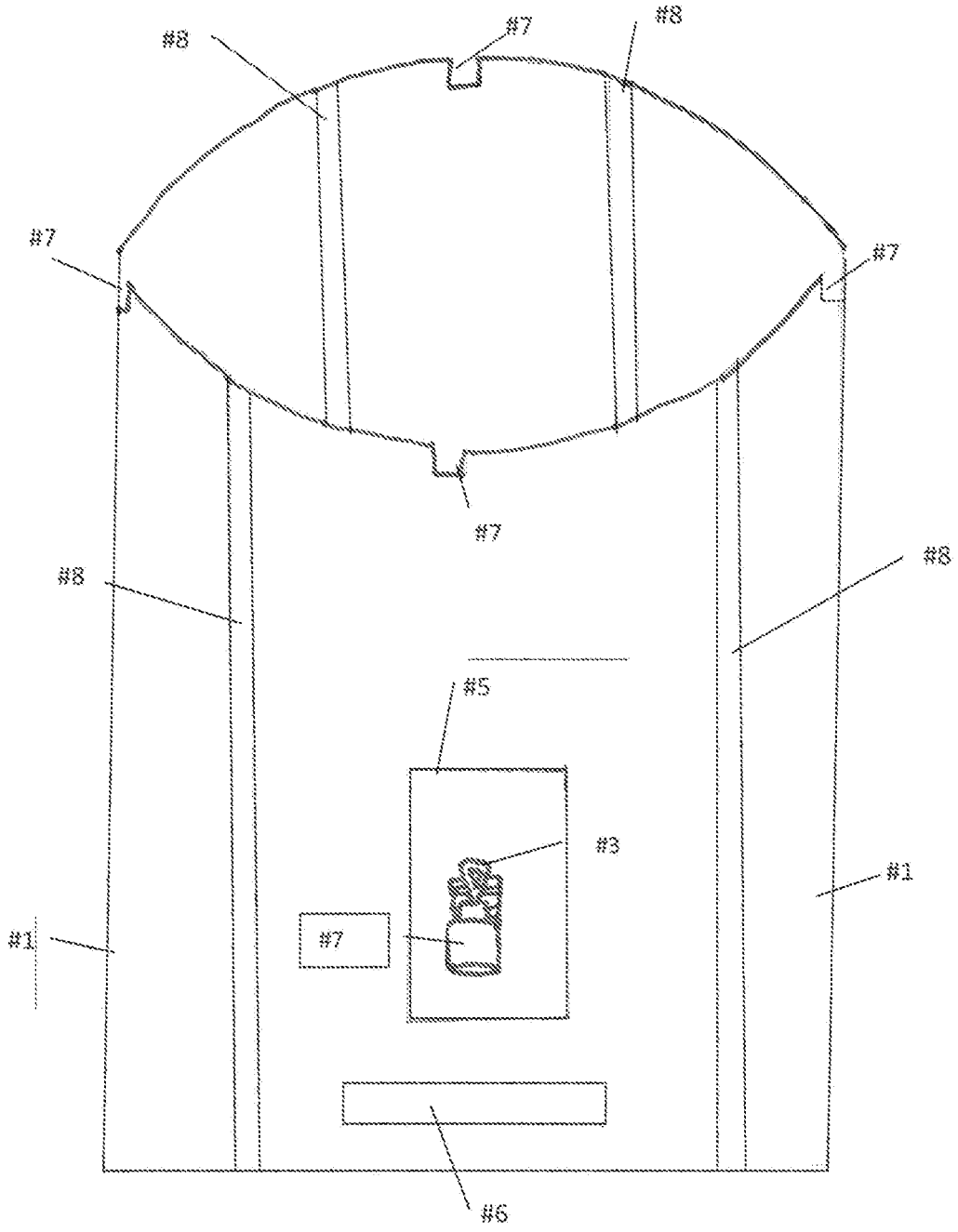
FIG. 7: Front view of Reservoir

FIG. 1 Flexible Tubing
FIG. 2 side view of device in use
FIG. 3 side view of device not in use
FIG. 4 side view of reservoir not in use
FIG. 5 side view of reservoir in use
FIG. 6 front view of reservoir not in use
FIG. 7 front view of reservoir in use

The invention claimed is:

1. A container comprising:

a reservoir having a housing, the reservoir holding a flowable substance;

a spigot comprising a button or handle for allowing the flowable substance to flow out of the reservoir when the button or handle is pressed;

the reservoir housing having a shadow box comprising a recessed portion of the reservoir housing, wherein the spigot is located in the shadow box and does not protrude beyond a non-recessed housing wall whereby the spigot can be hidden behind the non-recessed housing wall; and, a hideaway tray that is hidden within the reservoir in a hideaway position until a user pushes aside of the tray thereby allowing for the tray to turn outward from the hideaway position to a use position to catch any drips or spills.

2. The container according to claim 1, further comprising flexible tubing used to expand and contract with pressure for allowing the substance to flow out of the reservoir.

3. The container according to claim 1, wherein the reservoir housing further comprises a lid and recessed cutouts in the non-recessed housing wall, wherein the recessed cutouts define a space between the housing and the lid when the lid is installed on the housing.

4. The container according to claim 1, further comprising clear strips along the reservoir housing, the clear strips allow a user to view a level of the substance in the reservoir.

5. The container according to claim 1, wherein the housing is formed from a plastic material.

* * * * *